United States Patent [19]

Carter

[11] Patent Number: 5,031,247

[45] Date of Patent: Jul. 16, 1991

[54] LEG PROTECTOR

[76] Inventor: James E. Carter, P.O. Box 291054, Port Orange, Fla. 32129

[21] Appl. No.: 502,059

[22] Filed: Mar. 30, 1990

[51] Int. Cl.[5] ..... A41D 17/02; A41D 13/00

[52] U.S. Cl. ..... 2/242; 2/22; 2/62; 2/DIG. 6; 36/2 R

[58] Field of Search ..... 2/22, 23, 46, 61, 62, 2/242, 16, 59, DIG. 6; 36/1.5, 2 R

[56] References Cited

U.S. PATENT DOCUMENTS

| | | | |
|---|---|---|---|
| 1,346,448 | 7/1920 | Ewing | 36/2 R |
| 2,262,564 | 11/1941 | Strother et al. | 36/2 R |
| 3,052,994 | 9/1962 | Johnston | 36/2 R |
| 3,424,153 | 1/1969 | Lewis | 2/242 |
| 3,605,122 | 9/1971 | Myers | 2/242 |
| 4,110,845 | 9/1978 | Chellis | 2/62 |

*Primary Examiner*—Werner H. Schroeder
*Assistant Examiner*—Amy Brooke Vanatta

[57] ABSTRACT

A protective leg covering is manufactured from a single piece of material. The material is cut into a blank having a rectangular shape. It is designed to be wrapped around the leg, securing snugly but comfortably two to three inches above the knee with the longitudinal edges of the leg section extending down to the top of the arch of the foot in front and above the bottom of the heel in back. A hook and pile closure sewn at the corners of the top and the bottom elevations of said blank of material provides the user with adjustability to the desired snugness of the fit. The device is light weight, having no metal strips, straps or other heavy objects required in its construction, requires nothing to be removed or adjusted on the leg or foot to be attached to the leg of the wearer, and is easy and quick to put on and take off.

1 Claim, 2 Drawing Sheets

LEG PROTECTOR

BACKGROUND OF THE INVENTION

1. Field of the Invention

The present invention relates to protective wearing apparel, and more particularly to comfortable, exterior apparel for the protection of the leg from above the knee to the top of the arch of the foot.

2. Description of the Prior Art

As man has developed in the civilized world, as it is known today, he has had to develop different means to protect the leg through these development stages. One such device, as disclosed in U.S. Pat. Ser. No. 1,749,789, was needed only when man was able to turn solid metal into molten hot liquid. Prior to this ability to create molten liquid, man had no need for such a fireproof legging.

The same is true of the need that was the source for the development of the present invention. No known prior art is known to exist that embodies the spirit of the present invention. The present leg protector was developed to protect the leg from the pain and injury sustained while operating an electric or gas powered string trimmer such as is commonly used in the maintenance of lawns and ditches everywhere. Because of the recent invention of the string trimmer, this concept for leg protection was only recently created. The present invention addresses this need directly.

The leg protector offers the user a means of protection heretofore unknown or unavailable and because of the serious pain and/or injury that is generated by said string trimmers and the dirtying debris that is thrown against the leg of the user, a need exists for the protection of the leg of the user that is comfortable, easy to put on, quick to take off, economical and with the adjustability to fit the leg of different size wearers.

SUMMARY OF THE INVENTION

The present invention provides an inexpensive and lightweight leg protector that is secured snugly above the knee of the wearer and that fastens at the base of the elevation resting on top of the arch of the foot. The present invention is adjustable to the size of the user's leg permitting normal blood circulation for the young and elderly. This is accomplished by the use of one rectangular-shaped piece of material; that material composition is determined by what the present invention is protecting from the leg of the user. For example: if the user was trying to protect himself from the harmful effects that spraying an herbicide or pesticide chemical from any type of spraying device could cause, either from direct contact of the chemical on the skin of the leg or through the permeation of the chemical on the covering of the leg, the very area that is most suseptable to ground application of chemicals, that material would be manufactured from goods that were resistant to that particular chemical. The same holds true if the user was trying to protect his leg from clean, potable water, such as when making adjustments on irrigation sprinklers; that material would be cut from a water repellant material, preferably vinyl, to protect the water from being absorbed by the covering on the leg and consequently soaking through, making contact with the leg of the user. Further, if the user is protecting himself during the operation of a string trimmer from the grit and flying debris that is created from the spinning action of the string trimmer's head, the material would be cut from preferably moderate weight cotton goods. The cotton material would offer the user the most comfort, have breathability and be light weight at the same time. The chemical resistant material can easily be rinsed free of any chemical residue and provide the user with a safe leg protector the next time chemicals are being applied at or near ground level. The water repellent material simply needs to be dried before it is next used, and the preferably cotton material leg protector can be washed after it has been sufficiently soiled to require the necessity for the leg protector to be cleaned in a washing machine or some similar type of washing activity and hung to dry prior to the next need for the protection that the cotton or similar cloth does provide.

DETAILED DESCRIPTION OF THE INVENTION

Figure 1:
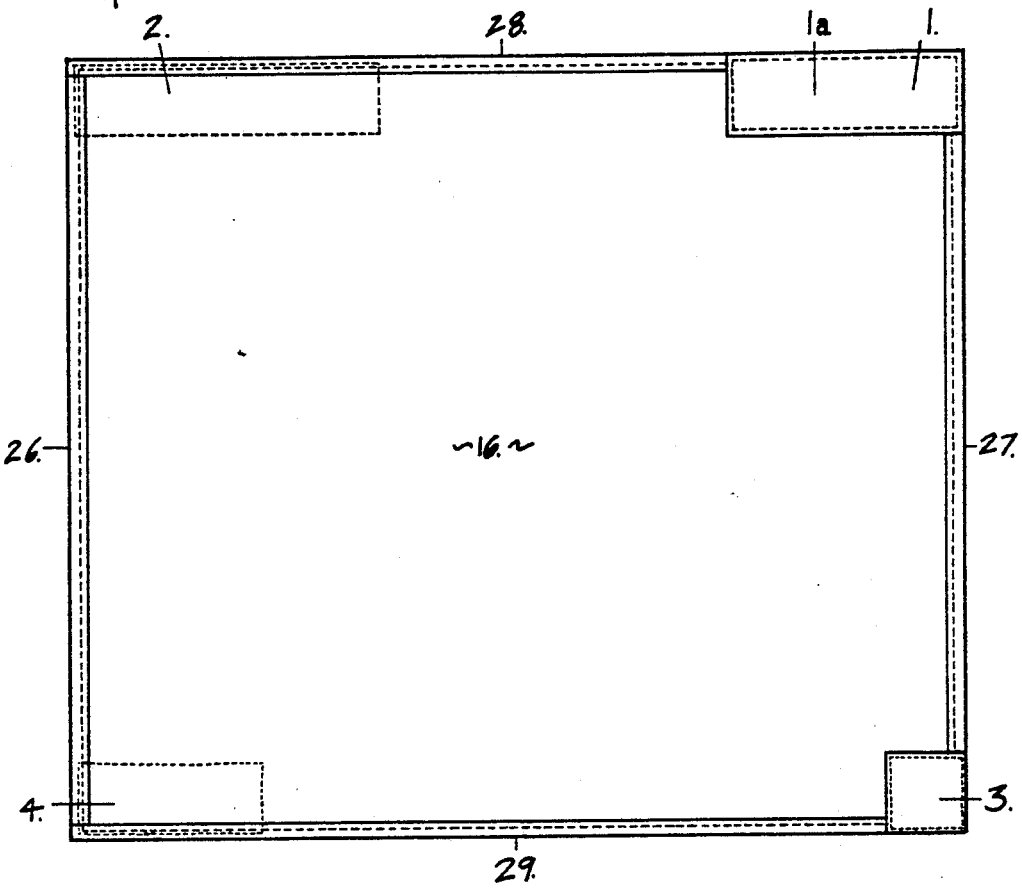
FIG. 1 shows the leg protector laid flat and opened out to more clearly illustrate the details of the inside of the leg protector that will be in contact with the leg of the wearer.
Figure 2:
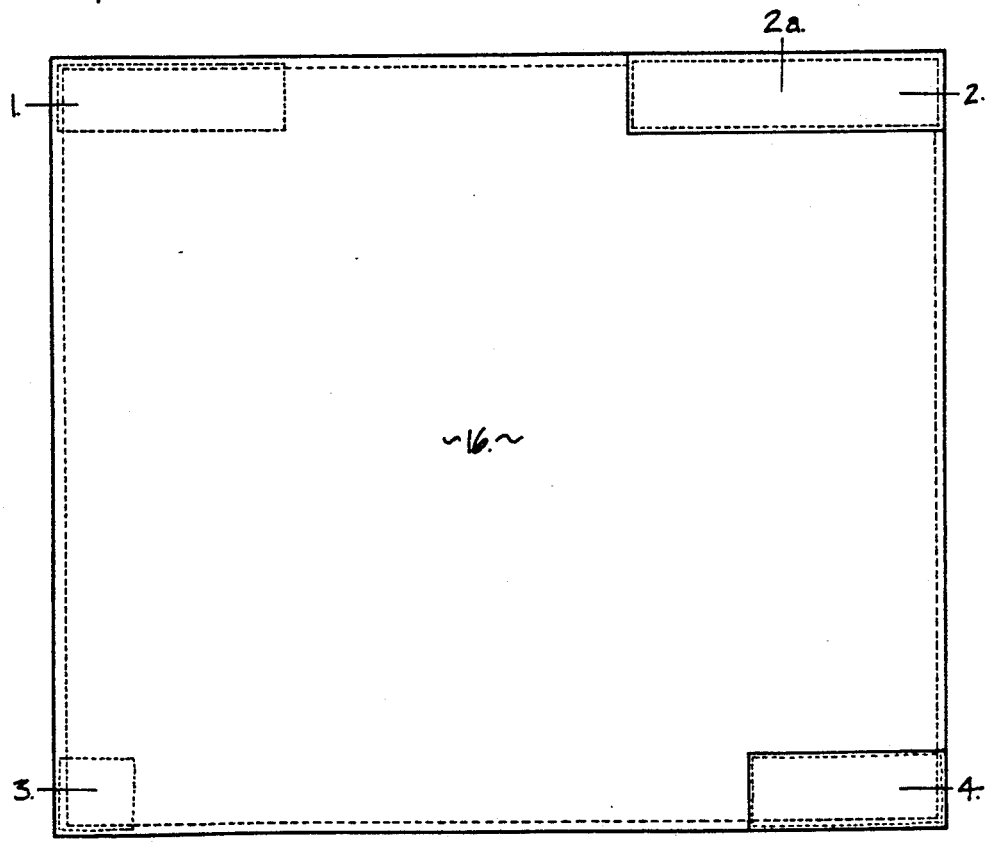
FIG. 2 is a front or outside view of the leg protector. It is the opposite side of that shown in FIG. 1.

As shown in the drawings, the protective article of clothing of the present invention is a leg protector or chap adapted to be worn around the leg of the user. The leg protector 16 as shown in FIG. 1 and FIG. 2 is comprised of a single blank sheet of material that is rectangular in shape. The lateral top edge 28 is preferably 23 inches wide and the lateral edge at the bottom elevation 29 is preferably 23 inches in width. The leg protector is wrapped FIG. 3 around the entire leg beginning from above the knee 24 extending longitudinally the length of the leg to the top of the arch of the foot 25.

The leg protector 16 is secured by means preferably of a hook and pile closure 1, 2, 3, and 4, at both the upper elevation and the lower elevation when properly attached to the wearer's leg. A vertical edge 27 is formed by the secure closure of the leg protector. This vertical edge 27 will be perpendicular to the ground when properly fastened.

The ability of the present invention's fastener 1 and 2, preferably velcro, to be secured to the user's leg with as small of an area of 1 inch hook secured to 1 inch of the pile of said velcro provides the wearer a wide range of adjustment for leg size. The fasteners 3 and 4 positioned at the lower elevation of the leg protector offer a degree of adjustment; however, this adjustment is not near as vital for the fit and snugness of the wearer but instead offers a closure of the vertical edge 27 that is formed when the leg protector is attached to the user. The vertical edge 27 otherwise would be left open, save the closure of 1 and 2, allowing whatever the user was protecting the leg from to enter. 3 finds its natural area for contact with 4, which is determined by the distance that 1 secures to 2 on the leg of the user, and secures by themselves. If 3 and 4 do not make contact, slight pressure with the fingers of the right hand will secure the said lower elevation. With secure closure at both the top edge 28 of the protector 16 and the lower edge 29 of leg protector the user is afforded the best possible protection from some of the harshest elements presented to man, whether it be natural or man-made.

Figure 3:
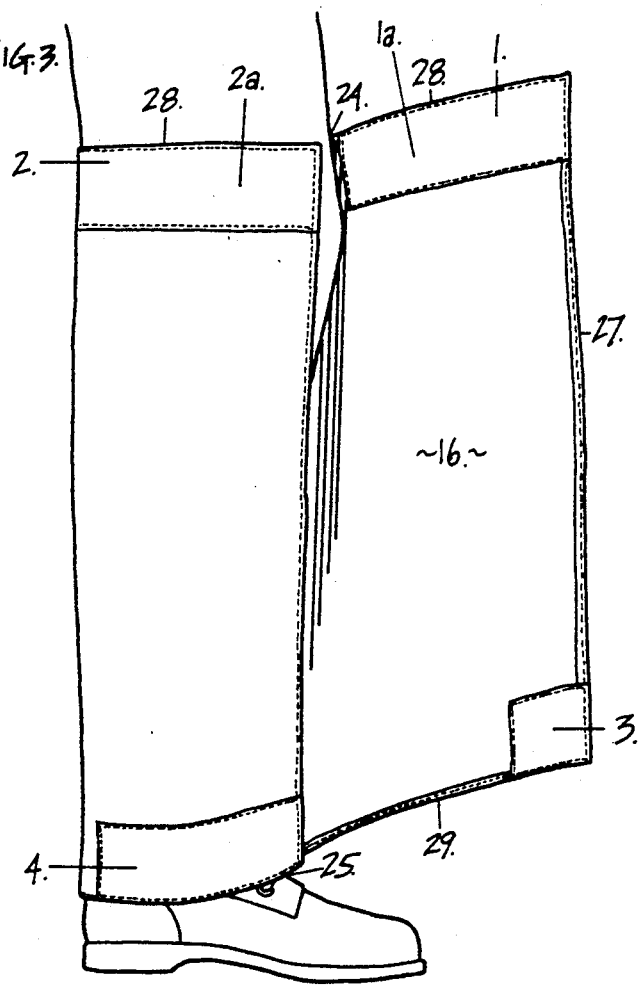
FIG. 3 is a perspective view of a right leg with the present invention partially applied thereto.

The one piece construction of the leg protector 16 allows the wearer to put on FIG. 3 and take off the present invention without the necessity to remove any article that may be covering the foot or leg.

To put on the leg protector 16 hold 1*a* with the left thumb and placing the four remaining fingers immediately behind 1, secure 2*a* with the four fingers of the right hand and having the right thumb directly behind 2 bring the material around the back of the leg to the front of the leg 24, stop two to three inches above the middle of the knee and preferably leave the index and middle finger pressured securely there 24. Bring 1 across the front of the leg aligning the top edge 28 of both 1 and 2 evenly as pressure is applied to complete the closure of the hook and pile fastener in a secure manner FIG. 4. Secured properly, the fit will allow the user to walk without any slippage of the leg protector or the possibility of creating any problems for normal blood circulation or similar discomfort.

Figure 4:
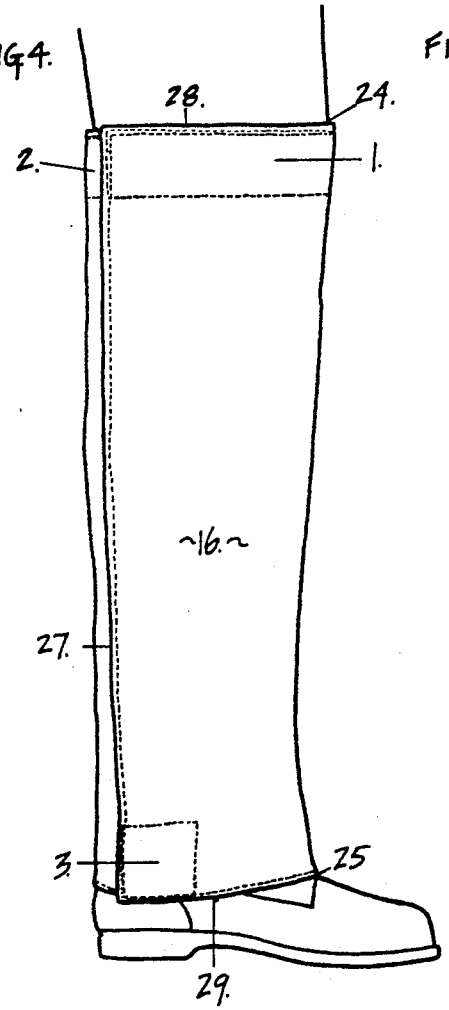
FIG. 4 is a side elevation view of the leg protector completely applied, embodying the principles of the present invention.

To protect the user to the maximum of the present invention, it is preferable to turn the vertical edge 27 toward the outside of the user's leg and slightly past the half way point toward the back as illustrated in FIG. 4. With 3 in secure contact with 4, a protective unit is created that has eliminated many of the cumbersome construction devices and tedious securements that have been common to many of the leg protectors heretofore proposed, thus providing a leg protector that not only is lightweight and durable but also offers a means to be put on and taken off with the least possible effort.

The present invention has a definite right leg protector and left leg protector. The drawings FIG. 1, FIG. 2, FIG. 3 and FIG. 4 were for the right leg. The description already presented detailing the manufacture and application of the present invention for the right leg applies exactly the same for the manufacture and application for the left leg. It is apparent that the objects, aims and advantages already stated above have been fully satisfied by the present invention. Although the present invention has been described in relationship with specific embodiments, it is obvious that anyone with a sense of design or an understanding of how it is that the leg can be best protected could make changes and take from the strength, simplicity and spirit of the present invention. Therefore, it is requested not to be bound by the foregoing except as may be required by the claims.

Having thus described the present invention I claim:

1. A leg protector for human leg comprising a rectangular sheet of material having a pair of lateral and a pair of horizontal edges adapted to be formed into a tube to surround the leg and having means for fastening the lateral edges of said sheet to form the tube; said fastening means comprising patches of hook and loop fasteners placed at said lateral edges along said pair of horizontal edges only, one of said patches placed at one of said horizontal edges being longer than the other of said patches at the other lateral edge to increase the range of adjustability of said fastening means.

* * * * *